US006767083B2

(12) United States Patent
Zhang

(10) Patent No.: US 6,767,083 B2
(45) Date of Patent: Jul. 27, 2004

(54) FLUID EJECTION DEVICE WITH DROP VOLUME MODULATION CAPABILITIES

(75) Inventor: Hongsheng Zhang, San Diego, CA (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/463,704

(22) Filed: Jun. 16, 2003

(65) Prior Publication Data

US 2003/0214562 A1 Nov. 20, 2003

Related U.S. Application Data

(62) Division of application No. 10/051,434, filed on Jan. 18, 2002, now Pat. No. 6,601,948.

(51) Int. Cl.[7] ..... B41J 2/045
(52) U.S. Cl. ..... 347/68; 347/48
(58) Field of Search ..... 347/68, 48, 69–72

(56) References Cited

U.S. PATENT DOCUMENTS 3,946,398 A 3/1976 Kyser et al.
4,393,384 A 7/1983 Kyser
4,499,479 A * 2/1985 Chee-Shuen Lee et al. .. 347/48
4,513,299 A 4/1985 Lee et al.
4,730,197 A 3/1988 Raman et al.
5,726,690 A 3/1998 Bohorquez et al.
5,731,828 A 3/1998 Ishinaga et al.
5,933,168 A 8/1999 Sakai

* cited by examiner

*Primary Examiner*—Judy Nguyen
(74) *Attorney, Agent, or Firm*—Mark W. Croll, Esq.; Donald J. Breh, Esq.; Welsh & Katz, Ltd.

(57) ABSTRACT

A method of controlling ink drop volume in an inkjet printhead includes the steps of providing a piezoelectric module. The module has a plate with an integrated ink chamber in flow communication with an integrated ink supply manifold and an integrated ink orifice. The ink chamber includes a main channel that connects the ink supply manifold to the ink orifice, and multiple piezoelectric actuators depending from the main channel and spaced apart by ink subchannels in flow communication with the main channel that define an array of piezoelectric actuators. A ground electrode is in contact with a first end of each of the actuators, and a cover plate is bonded to the piezoelectric plate to seal the chamber and the manifold. The cover plate is in contact with a control electrode and is configured to conduct control signals from the control electrode to the actuators. The method includes selectively activating one or more piezoelectric actuators in the array of piezoelectric actuators to create a pressure wave that propagates through the ink supply and ejects an ink drop the volume of which is dependent on the number of actuators that are activated is also disclosed.

4 Claims, 4 Drawing Sheets

FLUID EJECTION DEVICE WITH DROP VOLUME MODULATION CAPABILITIES

CROSS-REFERENCE TO RELATED APPLICATION DATA

This application is a divisional application of U.S. patent application Ser. No. 10/051,434, filed Jan. 18, 2002, now U.S. Pat. No. 6,601,948.

BACKGROUND OF THE INVENTION

The present invention relates to a piezoelectric fluid ejecting device, such as an inkjet printhead and methods of manufacturing the same. More particularly, the present invention relates to fluid ejecting devices in which the drop volume can be modulated.

There is a need for a piezo-electric printhead in which drop volume can be modulated. Desirably, such a printhead is configured to permit ready access to internal as well as external contacts between the actuators and electrodes. Most desirably, such a printhead can be fabricated in a "stacked" configuration to achieve high resolution print quality. It is also contemplated that such a device can be used to eject fluids other than ink, such as adhesives and the like. The present invention meets the above needs and has additional benefits as described in detail below.

SUMMARY OF THE INVENTION

In one embodiment, this invention achieves fluid drop formation and ejection with multiple actuators within a given fluid chamber. Each actuator is permitted to deform in multiple directions that all contribute to chamber volume change and ejection of the drop. In a current embodiment, such a device is configured for formation and ejection of ink drops. Other fluids are, however, contemplated, such as adhesives and the like.

Additionally, the multiple actuators can be selectively deformed to vary drop volume to achieve, for example, gray-scale printing. Varying drop volume during printing has to date been difficult to achieve for most ink jet printing methods, including thermal ink jet printing. The multiple actuators also allow for large print height without stitching.

Further, the instant invention does not require a diaphragm, which often is fragile and is a common source of failure in piezoelectric printheads. In typical piezoelectric printheads, the diaphragm is made of a pliable material and is connected to a piezoelectric element. When the piezoelectric element changes shape in response to a signal, it manipulates the diaphragm, which causes a pressure wave to propagate through the ink chamber and results in the ejection of ink through an orifice.

Additional benefits of one or more embodiments of the present invention include a highly integrated structure for low cost manufacturing, an easy-to-stack design for high-resolution printing, few or no thermal expansion issues between the piezoelectric material and a diaphragm, and excellent ink compatibility and corrosion resistance.

In one embodiment, the present invention contemplates an inkjet printhead including a piezoelectric module having a plate with an integrated ink chamber in flow communication with an integrated ink supply manifold and an integrated ink orifice. The ink chamber includes a main channel that connects the ink supply manifold to the ink orifice, and multiple piezoelectric actuators that depend from the main channel and are spaced apart by ink subchannels that are in flow communication with the main channel. This embodiment further includes a ground electrode that is in contact with a first end of each of the actuators and a cover plate that is bonded to the piezoelectric plate. The cover plate seals the chamber and the manifold. The cover plate is in contact with a control electrode and is configured to conduct control signals from the control electrode to the actuators.

This and alternative embodiments of the present invention can also include one or more of the following features: the piezoelectric module can include multiple ink chambers disposed on the piezoelectric plate, with successive chambers being separated by a chamber wall; the ink chambers can be in flow communication with a common ink supply manifold; the chamber walls can be separated by a cut between successive chambers.

An elastic membrane can be disposed between the cover plate and the piezoelectric plate. The elastic membrane can be electrically conductive, or parts of the elastic membrane can be electrically conductive based upon the arrangement of the actuators. The actuators can be selectively activated to modulate ink drop size. A restrictor can be disposed between the manifold and the main channel.

Multiple modules can be stacked together on the printhead. The stacked modules can be offset from each other. The actuators can be disposed perpendicular to the main channel. The actuators can be elongated toward the ink orifice. The first end of each actuator can tapered. The actuators can be shorter than the surrounding chamber walls. The actuators can be arranged parallel to each other.

In another embodiment, the present invention contemplates an inkjet printhead having means for piezoelectric actuation capable of both vertical and horizontal deformation in direct communication with means for supplying ink from an ink manifold to an ink ejection orifice and control means for supplying a signal to the piezoelectric actuation means.

The inkjet printhead also can include means for restricting the flow of ink between the ink supply means and the manifold. The inkjet printhead also can include multiple piezoelectric actuation means stacked together on a single printhead. The stacked actuation means also can be offset from each other.

In another embodiment, the present invention contemplates a method of controlling ink drop volume in an inkjet printhead including the steps of selectively activating one or more piezoelectric actuators in an array of piezoelectric actuators in direct communication with an ink supply to create a pressure wave that propagates through the ink supply and ejects an ink drop the volume of which is dependent on the number of actuators that are activated.

In this method, the actuators can be selectively activated by a control electrode electrically connected to the actuators. An electrically conductive elastic membrane also can conduct signals from the control electrode to the actuators to selectively activate same.

In another embodiment, the present invention contemplates an inkjet printer having a piezoelectric printhead as described above.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
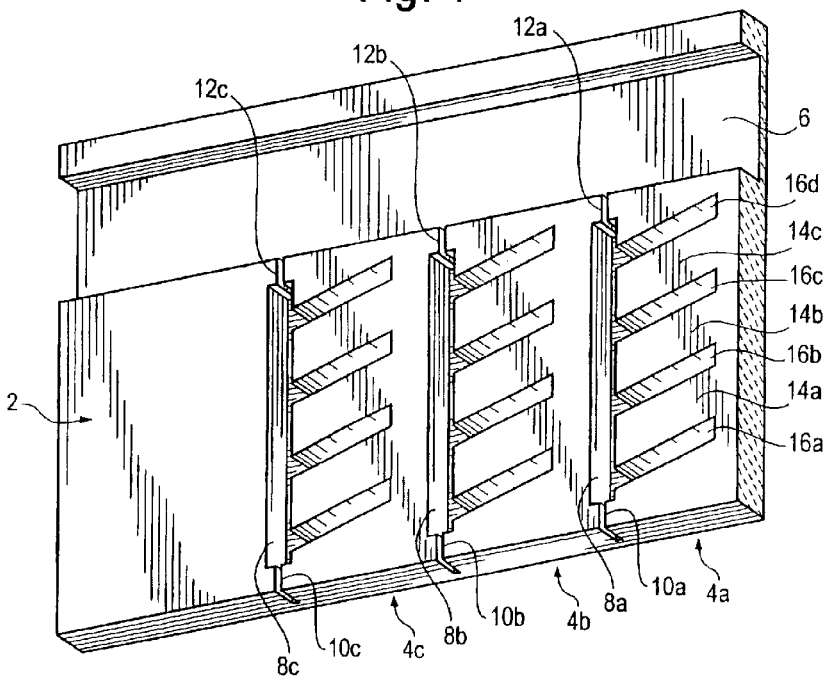
FIG. 1 is a perspective view of one embodiment of the inventive printhead.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to FIG. 1, it is seen that in one embodiment, the invention is directed to an inkjet printhead for an inkjet printer including a piezoelectric plate 2 with multiple integrated ink chambers 4*a*, 4*b*, 4*c* in flow communication with an integrated ink supply manifold 6. The ink chambers 4*a*, 4*b*, 4*c* respectively include main channels 8*a*, 8*b*, 8*c* that connect the ink supply manifold 6 at one end of the channels to ink orifices 10*a*, 10*b*, 10*c* at an Opposite end thereof.

In a given ink chamber, such as ink chamber 4*a*, multiple piezo electric actuators 14*a*, 14*b*, and 14*c* depend from the main channel 8*a* and are disposed in a comb-like arrangement, with adjacent actuators 14*a*, 14*b*, 14*c*, spaced apart by ink subchannels 16*a*, 16*b*, 16*c*, 16*d* in flow communication with the main channel 8*a*. The number of actuators in a given ink chamber preferably ranges from two (2) to twenty (20) or more, and which can be actuated separately and selectively to achieve drop size modulation and grayscale printing. Large-scale printing (on the order of 2–8 inches) without stitching is also possible because the same chamber pattern can be readily repeated on a relatively large and inexpensive ceramic plate, as compared to conventional silicon-based print heads in which costs increase significantly with increased size.

Restrictors 12*a*, 12*b*, 12*c* are disposed between the ink supply manifold 6 and the main channels 8*a*, 8*b*, 8*c*. The restrictors 12*a*, 12*b*, 12*c* control the flow of ink between the manifold 6 and the main channels 8*a*, 8*b*, 8*c*, and help to alleviate ink flow from the ink chambers 4*a*, 4*b*, 4*c* back into the manifold 6. This can be accomplished by a narrowing of the main channels 8*a*, 8*b*, 8*c* as it approaches the ink supply manifold 6, by a valve or by some other flow control device.

Figure 2:
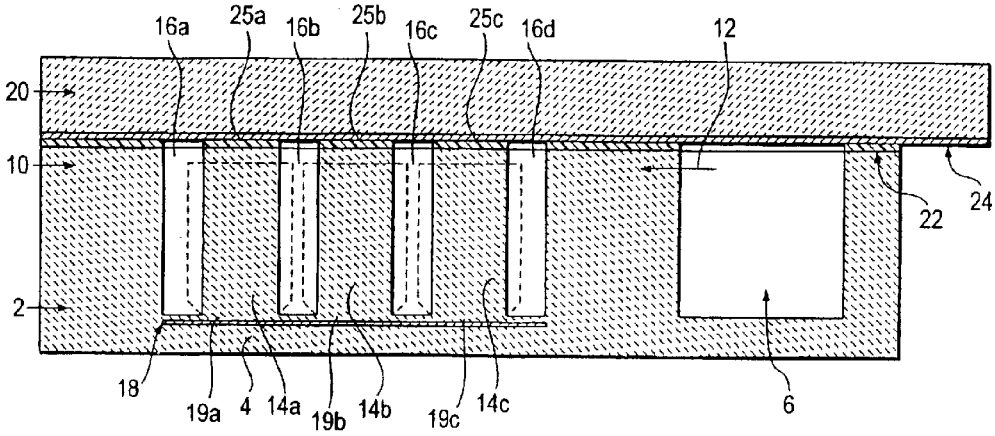
FIG. 2 shows a cross-sectional view of the working mechanism of the actuators.

Referring now to FIG. 2, it is seen that a common electrode or ground 18 is in contact with a first end 19 of each of the actuators. A cover plate 20 seals the ink chamber 4 and manifold 6. The cover plate 20 can be bonded to the piezoelectric plate 2 with a conductive elastic material 22. The cover plate 20 also contacts a control electrode 24 and conducts control signals from the control electrode 24 to individual electrodes 25*a*, 25*b*, 25*c* at a second end of the actuators 14*a*, 14*b*, 14*c*, which for example can be the top end of the actuators, such that the actuators 14*a*, 14*b*, 14*c* can be activated to cause an ink drop to eject through the orifice 10. In a preferred embodiment, the individual actuators 14*a*, 14*b*, 14*c* can be selectively activated to control the volume of the resultant ink drop. The volume of the ink drop increases in relation to the number of actuators that are activated.

When a voltage is applied between the control electrode 24 and the ground 18, the actuator 14 shrinks in the vertical direction (away from the cover plate), but expands horizontally into the adjoining subchannels 16 as shown by the dashed lines in FIG. 2. In this example the electric field is applied-in a direction that is parallel to the piezoelectric poling direction. During this actuation step, the elastic material 2 is pulled down along with the actuators 14. Ink between actuators 14 is thus squeezed and pushed out of the ink chambers toward the respective orifices to expel an ink drop.

The cover plate 20 can be any suitable material that is compatible with the piezoelectric material and can be coated or plated with metal, if this is the preferred location of the electrodes. The metal layer is then separated to form individual electrodes 25*a*, 25*b*, 25*c*, one for each chamber. The metal pattern can be arranged to allow for selective activation of individual actuators 14 within one ink chamber 4. In FIG. 2, for example, the three actuators 14 can be deflected all at once, or two, or even only one of the actuators 14 can be deflected at a given time. Thus, drop volume can be changed by simply selecting how many and which actuators 14 are deformed. This selective actuator deformation allows for gray-scale printing. Although, only three actuators 14 are shown in FIGS. 1 and 2, there can be twenty or more in one chamber, which results in an approximate drop volume on the order of 10–40' pL for a 100 dot-per-inch ("DPI") printhead.

Figure 3:
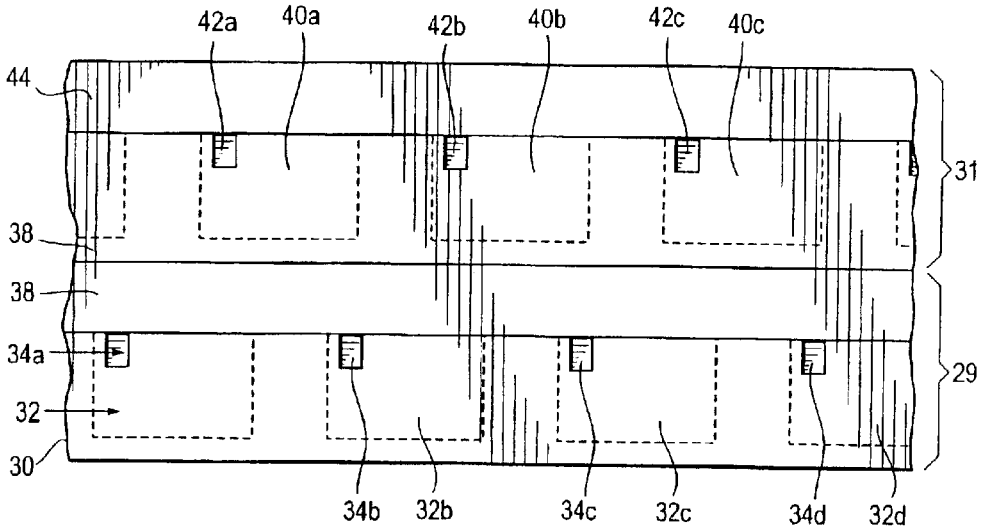
FIG. 3 shows the front view of a stacking arrangement for high-resolution applications.

Referring now to FIG. 3 it is seen that a first piezoelectric module 29 including plate 30 having multiple chambers 32*a*, 32*b*, 32*c*, 32*d* with orifices 34*a*, 34*b*, 34*c*, 34*d* and a cover plate 36 is stacked beneath a second piezo module 31 including plate 38, which also has multiple chambers 40*a*, 40*b*, 40*c* with orifices 42*a*, 42*b*, 42*c* and a cover plate 44. The chambers 32*a–d* and 40*a–c* are offset to allow for increased print density. Because each module has a thickness on the order of about 500 um–2 mm, several modules can be stacked together without sacrificing print quality due to large bank-to-bank distance.

Figure 4:
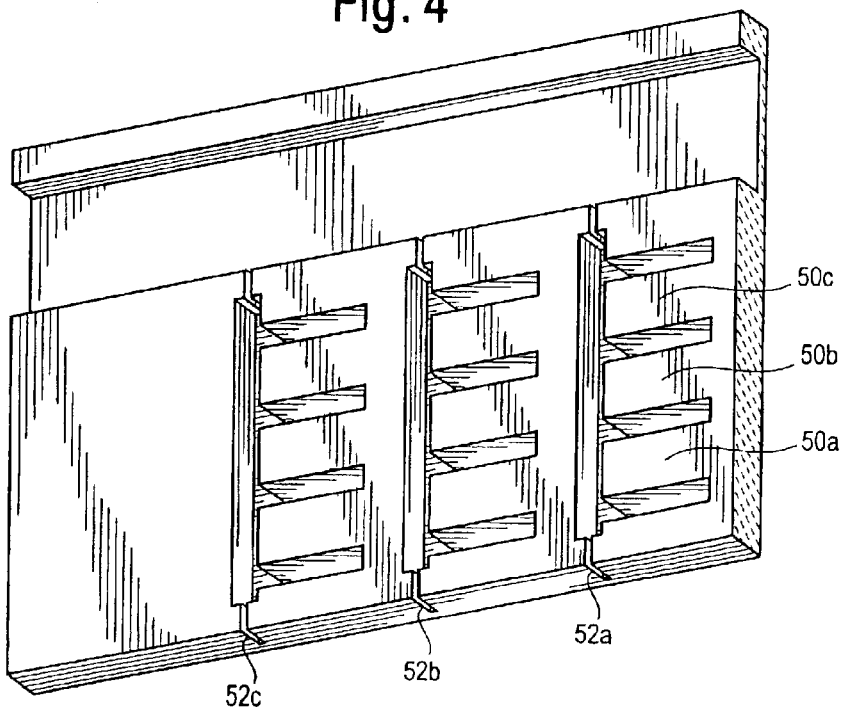
FIG. 4 shows an alternative embodiment in which actuators are perpendicular to ink channels for easier cutting.

Referring now to FIG. 4, it is seen that in an alternative embodiment, the actuators 50*a*, 50*b*, 50*c* can be arranged directly perpendicular to the ink channels 52*a–c*, rather than at an angle, as shown in FIG. 1, which allows for easier cutting and fabrication.

Figure 5:
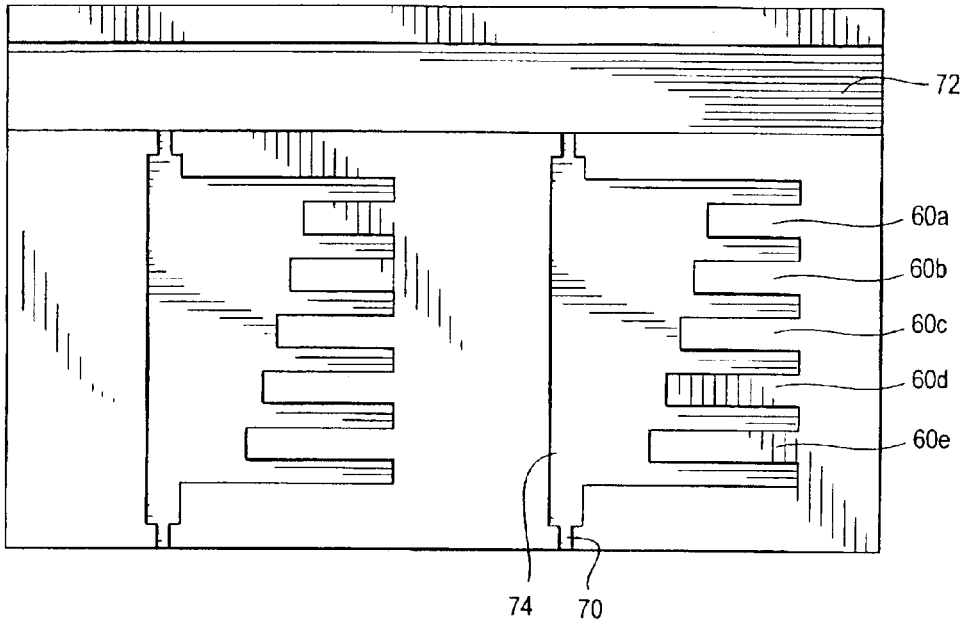
FIG. 5 shows an alternative embodiment in which actuators become longer toward the orifice to form a larger ink chamber.

Referring now to FIG. 5, it is seen that in still another embodiment, the actuators 60*a–e* become longer toward the orifice 70 to increase the capacity of the ink chamber 74.

Figure 6:
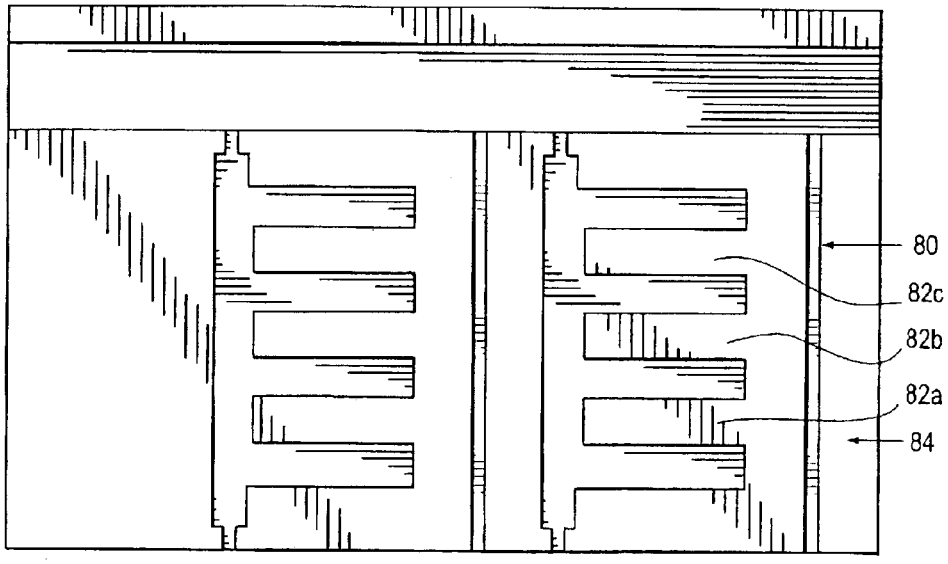
FIG. 6 shows a shallow cut to separate actuators from the wall.

Referring now to FIG. 6, it is seen that a shallow cut 80 can be used to separate actuators 82*a–c* from successive chamber walls 84. This cut 80 also helps to avoid deformation of the chamber walls 84, which may cause cross-talk between adjacent chambers.

Figure 7:
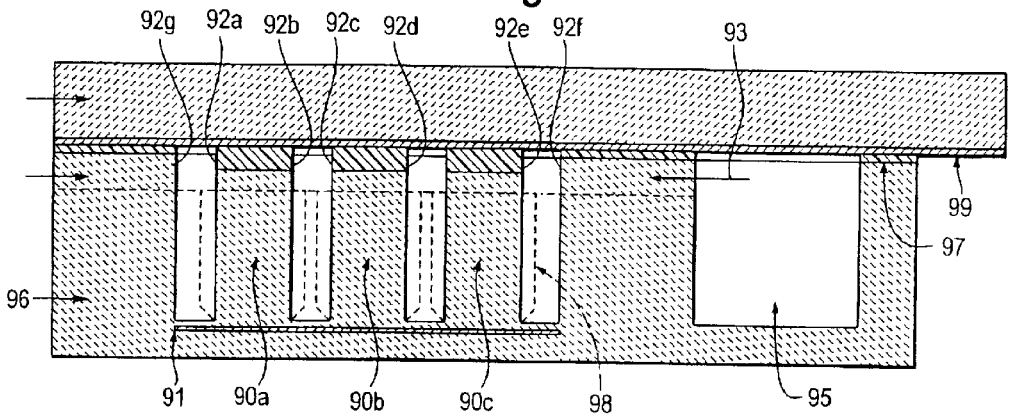
FIG. 7 shows an alternative embodiment where actuators are shorter than the surrounding walls.

Referring now to FIG. 7, it is seen that in yet another embodiment, the actuators 90*a–c* are shorter than the surrounding walls 92*a–d*. The actuators 90*a–c* can be shortened in relation to the surrounding walls 92*a–d* by ablation before all chambers are formed. Shortening the actuators 90*a–c* in relation to the surrounding walls 92*a–d* increase the rigidity of cover plate 94 and chamber plate 96 bonding without sacrificing the freedom of individual actuators 90*a–c*. Also shown are ground electrode 91, restrictor 93, ink manifold 95, control electrode 99 and elastic material 97 that bonds the cover plate to the piezoelectric plate and also conducts electricity from the control electrode to the individual actuators 90*a–c*. The dotted lines show the piezoelectric material contracting in the vertical direction and expanding in the horizontal direction in response to signals from the control electrodes.

Figure 8:
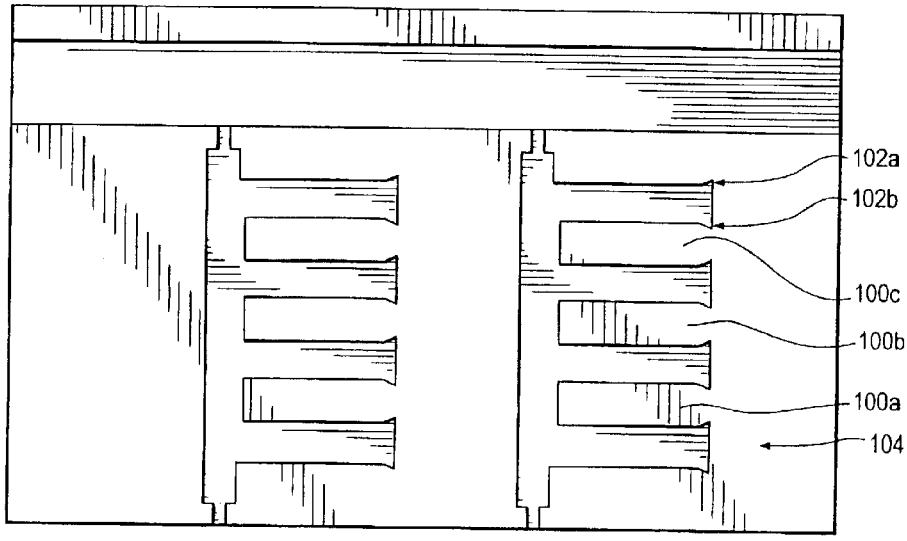
FIG. 8 shows an alternative embodiment with additional cuts around the cover to allow for additional actuator deformation.

Referring now to FIG. 8, it is seen that in an other embodiment, additional cuts 102*a–b* are made around the corners of the base of the actuators 100*a–c*, where the actuators meet the chamber wall 104. The resulting tapered actuators 100*a–c* allow for additional deformation space and hence greater ink displacement.

In the disclosures, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A method of controlling ink drop volume in an ink-jet printhead comprising the steps of:

providing a piezoelectric module having a plate with an integrated ink chamber in flow communication with an integrated ink supply manifold and an integrated ink orifice, the ink chamber including a main channel that connects the ink supply manifold to the ink orifice and multiple piezoelectric actuators depending from the main channel and spaced apart by ink subchannels in flow communication with the main channel the multiple piezoelectric actuators defining an away of piezoelectric actuators, a ground electrode in contact with a first end of each of the actuators, and a cover plate bonded to the piezoelectric plate to seal the chamber and the manifold, the cover plate being in contact with a control electrode and configured to conduct control signals from the control electrode to the actuators; and selectively activating one or more of the piezoelectric actuators in the array of piezoelectric actuators to create a pressure wave that propagates through the ink supply and ejects an ink drop the volume of which is dependent on the number of actuators that are activated.

2. The method of claim 1 wherein an electrically conductive elastic membrane conducts signals from the control electrode to the actuators to selectively activate same.

3. A method of controlling fluid drop volume in a fluid ejecting device comprising the steps of:

providing a piezoelectric module comprising a plate with an integrated fluid chamber in flow communication with a fluid supply and a fluid orifice, the fluid chamber including a main channel that connects the fluid supply to the fluid orifice, and multiple piezoelectric actuators depending from the main channel and spaced apart by fluid subchannels in flow communication with the main channel, the multiple piezoelectric actuators defining an array of piezoelectric actuators, a ground electrode in contact with a first end of each of the actuators, and a cover plate bonded to the piezoelectric plate to seal the chamber and the fluid supply, the cover plate being in contact with a control electrode and configured to conduct control signals from the control electrode to the actuators; and selectively activating one or more of the piezoelectric actuators in the array of piezoelectric actuators to create a pressure wave that propagates through the fluid supply and ejects a fluid drop the volume of which is dependent on the number of actuators that are activated.

4. The method of claim 3 wherein an electrically conductive elastic membrane conducts signals from the control electrode to the actuators to selectively activate same.

* * * * *

UNITED STATES PATENT AND TRADEMARK OFFICE

CERTIFICATE OF CORRECTION

PATENT NO. : 6,767,083 B2
DATED : July 27, 2004
INVENTOR(S) : Hongsheng Zhang

It is certified that error appears in the above-identified patent and that said Letters Patent is hereby corrected as shown below:

Column 5,
Line 39, should read -- A method of controlling ink drop volume in an inkjet printhead comprising the steps of: --

Column 6,
Lines 2-3, should read -- communication with the main channel, the multiple piezoelectric actuators defining an array of piezoelectric actuators, --

Signed and Sealed this

Thirtieth Day of November, 2004

JON W. DUDAS
*Director of the United States Patent and Trademark Office*